United States Patent [19]

Francia et al.

[11] Patent Number: 4,736,719

[45] Date of Patent: Apr. 12, 1988

[54] SYSTEM FOR LIMITING THE MAXIMUM SPEED OF AN INTERNAL COMBUSTION ENGINE COMPRISING AN ELECTRONIC INJECTION SYSTEM

[75] Inventors: Paolo Francia, Zola Predosa; Michele Scarnera, Monzuno, both of Italy

[73] Assignee: Weber S.p.A., Turin, Italy

[21] Appl. No.: 881,196

[22] Filed: Jul. 2, 1986

[30] Foreign Application Priority Data

Jul. 12, 1985 [IT] Italy ..... 67642 A/85

[51] Int. Cl.[4] ..... F02D 41/14

[52] U.S. Cl. ..... 123/333; 123/198 DB

[58] Field of Search ..... 123/323, 333, 198 DB, 123/198 D

[56] References Cited

U.S. PATENT DOCUMENTS 3,736,910 6/1973 Raff ..... 123/198 DB 4,371,050 2/1963 Ikeura ..... 123/198 DB

*Primary Examiner*—William A. Cuchlinski, Jr.

*Attorney, Agent, or Firm*—Gifford, Groh, VanOphem, Sheridan, Sprinkle and Dolgorukov

[57] ABSTRACT

A system for limiting the maximum speed of an internal combustion engine comprising an electronic injection system, which system comprises first means for detecting when the speed of the engine exceeds a first given threshold value, and for consequently disabling fuel supply to the injectors, and second means for determining whether the speed of the engine exceeds a second given threshold value higher than the first threshold value, and for consequently maintaining disabled or enabling fuel supply.

5 Claims, 2 Drawing Sheets

SYSTEM FOR LIMITING THE MAXIMUM SPEED OF AN INTERNAL COMBUSTION ENGINE COMPRISING AN ELECTRONIC INJECTION SYSTEM

BACKGROUND OF THE INVENTION

The present invention relates to a system for limiting the maximum speed of an internal combustion engine comprising an electronic injection system, in particular, a timed, sequential electronic injection system. Electronic injection systems on internal combustion engines are known to present an electronic control system which, depending on signals received from various sensors (mainly engine speed/stroke and air intake pressure/temperature sensors) determines, for example, the air density in the manifold and engine speed, and calculates, via interpolation on respective memorized maps, the stroke and timing for injecting fuel into the injectors, as well as the spark lead. On such electronic injection systems, maximum engine speed is usually limited by disabling fuel supply to the injectors, upon engine speed reaching a given limit threshold value, fuel supply to the injectors being re-enabled upon engine speed falling below a second given threshold value, about a few hundred r.p.m. lower than the first. Such a method of limiting maximum engine speed presents a number of drawbacks. Such a sharp interruption in fuel supply to the injectors, which persists until engine speed drops below the second lower threshold, results in a noticeable and continuous reduction in the drive torque on the engine, which may at times result in impaired driving performance.

SUMMARY OF THE INVENTION

The aim of the present invention is to provide a system for limiting the maximum speed of an internal combustion engine, and involving none of the aforementioned drawbacks, i.e. a system enabling maximum engine speed to be limited to below a given limit value, but without causing a sharp reduction in the drive torque on the engine.

Further aims and advantages of the system according to the present invention will be disclosed in the following description.

With this aim in view, according to the present invention, there is provided a system for limiting the maximum speed of an internal combustion engine comprising an electronic injection system, characterised by the fact that it comprises first means for detecting when the speed of the said engine exceeds a first given threshold value, and for consequently disabling fuel supply to the injectors, and second means for determining whether the speed of the said engine exceeds a second given threshold value higher than the said first threshold value, and for consequently maintaining disabled or enabling the said fuel supply.

BRIEF DESCRIPTION OF THE DRAWINGS

One embodiment of the present invention will be described, by way of a non-limiting example, with reference to the accompanying drawings, in which.

DETAILED DESCRIPTION OF THE INVENTION

Figure 1:
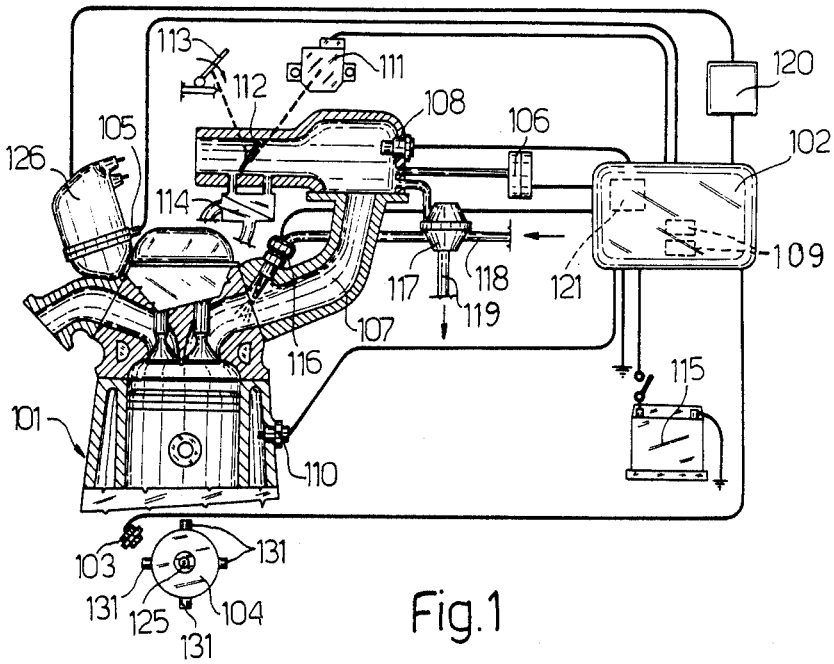
FIG. 1 shows a schematic view of an electronic injection system for an internal combustion engine with a maximum speed limiting system according to the present invention.

FIG. 1 shows, schematically, an electronic injection system for an internal combustion engine 101, conveniently a four-cylinder engine, shown partially and in cross section.

The said system comprises an electronic control system 102 comprising, in substantially known manner, a microprocessor 121, and registers in which are memorized maps relative to various operating conditions of engine 101. The said control system 102 also comprises memory registers 109, and receives signals from:

a sensor 103, for detecting the speed of engine 101, located opposite a pulley 104 fitted onto drive shaft 125 and having four teeth 131 equally spaced at 90° intervals;

a sensor 105, for detecting the stroke of engine 101 and located in a distributor 126;

a sensor 106, for detecting the absolute pressure inside an induction manifold 107 on engine 101;

a sensor 108, for detecting the air temperature inside manifold 107;

a sensor 110, for detecting the water temperature inside the cooling jacket on engine 101;

a sensor 111, consisting substantially of a potentiometer, for detecting the setting of a throttle valve 112 located inside induction manifold 107 and controlled by the pedal of accelerator 113; parallel to the said throttle valve 112, there is provided an additional air supply valve 114. The said electronic control system 102 is connected to an electricity supply battery 115 and grounded, and, depending on the signals from the said sensors, engine speed and air density are employed for determining fuel supply according to the required mixture strength. The said control system 102 therefore controls the opening time of electroinjectors 116 located inside manifold 107 next to the intake valve of each respective cylinder, for controlling fuel supply to the cylinders on engine 101, and also controls injection timing for commencing fuel supply according to the stroke (induction, compression, expansion, exhaust) of engine 101. Each electroinjector 116 is supplied with fuel via a pressure regulator 117 sensitive to the pressure inside induction manifold 107 and having a fuel inlet duct 118 from a pump (not shown) and a return duct 119 to a tank (not shown). Electronic control system 102 is also connected to a unit 120 for controlling the ignition pulses supplied to distributor 126.

Figure 3:
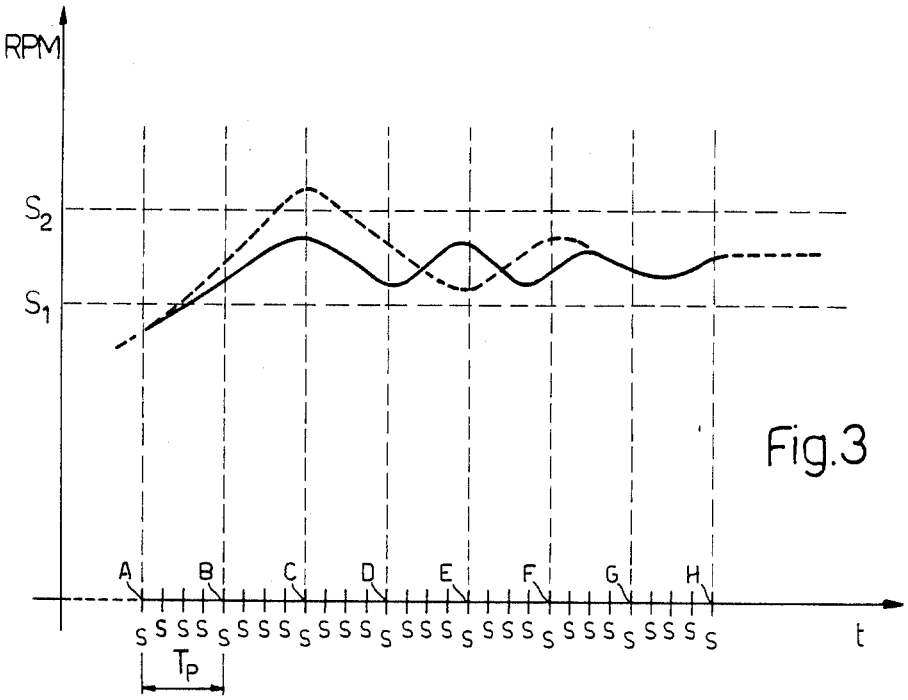
FIG. 3 shows a maximum speed/time graph, using the maximum speed limiting system according to the present invention.
Figure 2:
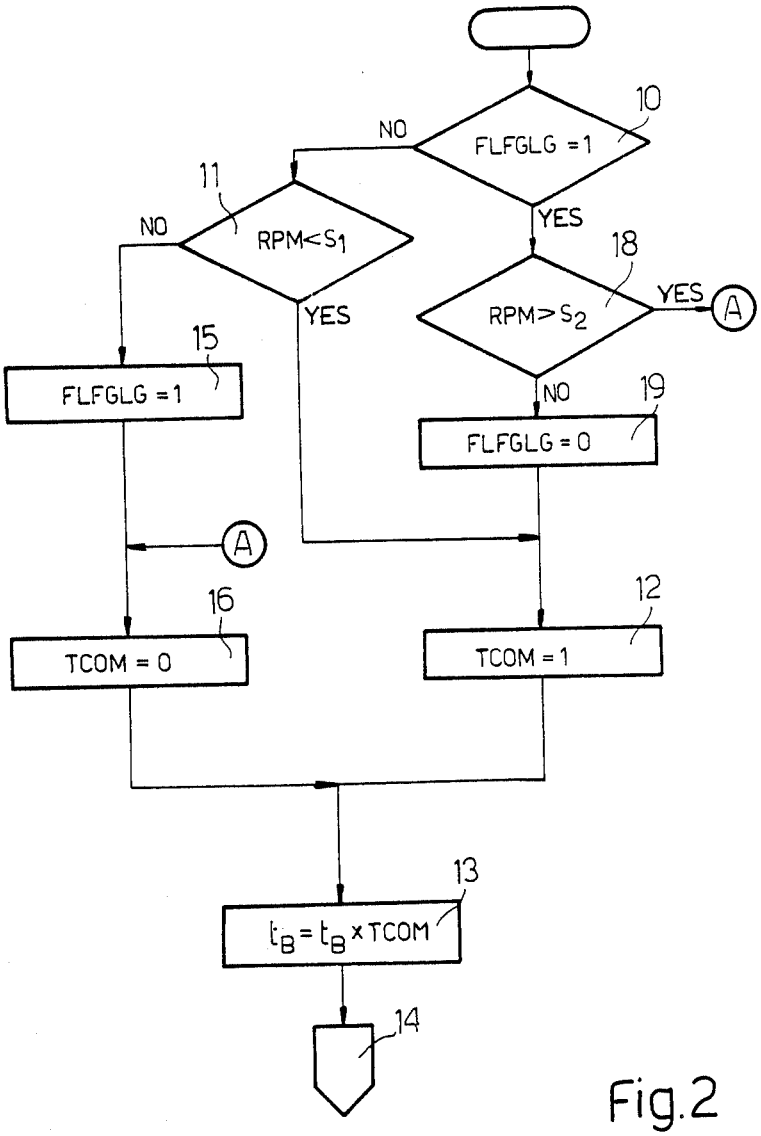
FIG. 2 shows an operating block diagram of the maximum speed limiting system according to the present invention.

Operation of the maximum speed limiting system according to the present invention will now be described with reference to FIGS. 2 and 3, which FIG. 3 shows a graph of the speed of engine 101 detected by sensor 103 (RPM) plotted against time (t). $S_1$ and $S_2$ are the two limit values within which maximum speed limitation operates. As shown in FIG. 2, each cycle of the electronic injection system routine controlled by microprocessor 121 goes to a block 10, which determines whether maximum speed limiting register 109 (FLFGLG) contains a memorized value of 1, as described later on. In the event of a negative response, block 10 goes on to block 11, which determines whether the speed of engine 101 is below threshold value $S_1$. In the event of a positive response (not requiring operation of the maximum speed limiting system according to the present invention), block 11 goes on to block 12, which enters a content value of 1 in register TCOM and then goes on to block 13, which calculates basic injection time (i.e. the opening time of electroinjectors 116) by multiplying $t_B$ as calculated by microprocessor 121 by the value of the said register TCOM. Block 13 then goes on to block 14, which controls subsequent operation of the routine by microprocessor 121 for actuating sequential, timed supply to electroinjectors 116. In the event of a negative response in block 11, i.e. the speed of engine 101 exceeds threshold $S_1$, block 11 goes on to block 15, which enters a value of 1 in register 109 (FLFGLG) and then goes on to block 16, which updates register TCOM to 0. Block 16 then goes on to block 13, which, in this case, enters a $t_B$ value of 0 as the opening time of electroinjectors 116. In the event of a positive response in block 10, block 10 goes on to block 18, which determines whether the speed of engine 101 exceeds threshold value $S_2$. In the event of a positive response, block 18 goes on to block 16, whereas, in the event of a negative response, block 18 goes on to block 19, which enters a 0 in register 109 (FLFGLG) and then goes on to block 12.

With reference to FIG. 3, the X axis of the graph shown therein indicates the detection times of signals S supplied by sensor 103, subsequent to being swept by teeth 131, and substantially relative to approximately the maximum speed of engine 101. $T_p$ indicates the repeat time of the processing cycle in the injection system routine controlled by microprocessor 121, the said time $T_p$ being approximately equal to the duration of two strokes of engine 101 under such typical speed limiting conditions (6,000–7,000 r.p.m.). (A pair of S signals is supplied by sensor 103 for each stroke of engine 101). As shown by the continuous line on the FIG. 3 graph, at starting point A, the speed of engine 101 is below the $S_1$ threshold. Block 10 in FIG. 2 therefore issues a negative response and goes on to block 11 which, issuing a positive response, goes on to block 12, which makes no change in the injection time $t_B$ calculated in block 13, so that the speed of engine 101 will continue increasing in the absence of any change in the control of accelerator 113 by the driver. In the next repeat cycle of the routine controlled by microprocessor 121, starting from point B at which engine speed exceeds threshold $S_1$, block 10 again issues a negative response and goes on to block 11 which, in this case however, issues a negative response (i.e. engine speed over threshold $S_1$) and goes on to block 15. This enters a 1 in register 109 (FLFGLG) and goes on to block 16, which enters a 0 in register TCOM for cancelling, via block 13, the enabling time of injectors 116. As a result, the speed of engine 101 will tend to rise more slowly. In more detail, in the case shown in FIG. 3, the interval between points B and C covers roughly two strokes of engine 101, so that fuel supply will be disabled to two injectors 116 relative to the cylinders performing the strokes in question. In the next repeat cycle of the program by microprocessor 121, starting from point C at which the speed of engine 101 is still above threshold $S_1$ but below threshold $S_2$, block 10 now detects the positive condition determined in the foregoing processing cycle by block 15 and therefore goes on to block 18 which, issuing a negative response, goes on to block 19, which enters a 0 in register 109 (FLFGLG) and goes on to block 12. This enters a 1 in register TCOM which, via block 13, once again enables fuel supply to electroinjectors 116 for the calculated time $t_B$. Consequently, in the interval between points C and D, the speed of engine 101 first falls off, due to prior disabling of the fuel supply, followed by a gradual reduction in deceleration and an increase in engine speed. In the interval between points D and E, in which a further processing cycle is performed by microprocessor 121, block 10 detects the negative condition determined previously by block 19 and therefore goes on to block 11 which, also detecting a negative condition, goes on to block 15 and, from there, to block 16, which again cancels the enabling time of electroinjectors 116. As a result, in the said interval between points D and E, engine speed will first increase, due to prior enabling of injectors 116, and then trail off towards the end. The same process is repeated in subsequent program cycles by microprocessor 121 so that, as shown in FIG. 3, the speed of engine 101 tends to remain steady between thresholds $S_1$ and $S_2$.

If, on the other hand, engine 101 presents such a steep positive acceleration curve that, despite fuel supply being cut off to injectors 116 by the program in the processing cycle between points B and C, engine speed at point C exceeds threshold $S_2$ as shown by the dotted line in FIG. 3, in the interval between points C and D, block 10 detects the positive condition determined previously by block 15 and therefore goes on to block 18 which, again detecting a positive condition, goes on to block 16 which continues to maintain fuel supply to electroinjectors 116 disabled. As a result, in the interval between points C and D, engine speed will decrease steadily. In the next interval D-E, block 10 detects a positive condition, whereas block 18 detects a negative condition and therefore goes on to block 19 and, from there, to block 12, which once more enables fuel supply to injectors 116. As a result, deceleration is reduced and engine speed tends to rise. Subsequent processing cycles are as already described and, in this case also, engine speed tends to remain steady, halfway between thresholds $S_1$ and $S_2$.

The advantages of the system according to the present invention, for limiting the maximum speed of an internal combustion engine comprising an electronic injection system, will be clear from the foregoing description. When engine speed reaches a given upper threshold, instead of fuel supply to the injectors being disabled until engine speed falls below a second lower threshold, fuel supply to the injectors is enabled and disabled alternately, so as to maintain engine speed within a range extending between two thresholds $S_1$ and $S_2$ encompassing the required maximum engine speed. Consequently, providing engine speed is not changed by the driver operating accelerator 113, engine speed is maintained steadily within the said range, i.e. close to the required speed, with no noticeable discomfort on the part of the driver, and no impairment of driving safety caused by a sharp fall in the drive torque. Furthermore, enabling and disabling of fuel supply to electroinjectors 116 is alternated fairly frequently, such frequency being determined by the processing cycle time of the electronic injection system routine, which, at the maximum speed of engine 101, may range from 1.5 to 2 strokes of engine 101.

To those skilled in the art it will be clear that changes may be made to the embodiment and characteristics of the maximum speed limiting system described herein without, however, departing from the scope of the present invention.

We claim:

1. A system for limiting the maximum speed of an internal combustion engine (101) comprising an electronic injection system, comprising first means (11, 16) for detecting when the speed of the said engine (101) exceeds a first threshold value ($S_1$) and for consequently disabling fuel supply to the injectors (116), and second means (18, 12) for determining whether the speed of the engine (101) exceeds a second threshold value ($S_2$) higher than the said first threshold value ($S_1$), and for maintaining the fuel supply disabled if the engine speed is greater than said second threshold value and otherwise enabling said fuel supply.

2. A system as claimed in claim 1, characterised by the fact that it comprises third means (10) which detect disabling of the fuel supply by said first means (11) and enables said second means (18) in a processing cycle of the electronic injection system routine subsequent to the cycle in which said first means determines that said first threshold value ($S_1$) is exceeded and which also detects enabling of the fuel supply by said second means (18) and enables said first means (11) in a processing cycle subsequent to the cycle in which said second means determines that said second threshold ($S_2$) is not being exceeded.

3. A system as claimed in claim 2, characterised by the fact that the duration ($T_p$) of the said processing cycle of the said electronic injection system routine is approximately equal to the duration of a number of strokes of the said engine (101).

4. A system as claimed in claim 2, characterised by the fact that the said first (11, 16), second (18, 12) and third (10) means form part of a microprocessor (121) controlling the said electronic injection system.

5. A system as claimed in claim 1, characterised by the fact that the said first ($S_1$) and second ($S_2$) threshold values are fixed about a given maximum speed of the said engine (101), and that the said first ($S_1$) and second ($S_2$) threshold values differ by a few hundred revolutions.

* * * * *